United States Patent [19]

Loesch et al.

[11] 4,438,729

[45] Mar. 27, 1984

[54] FLAMELESS NITROGEN SKID UNIT

[75] Inventors: Stanley B. Loesch; James C. St. John; Danny K. Mints, all of Duncan, Okla.

[73] Assignee: Halliburton Company, Duncan, Okla.

[21] Appl. No.: 136,047

[22] Filed: Mar. 31, 1980

[51] Int. Cl.[3] ..... F22B 3/06; F17C 7/02

[52] U.S. Cl. ..... 122/26; 122/20 B; 126/247; 237/12.1; 62/53

[58] Field of Search ..... 237/1 R, 12.3 B, 12.1; 122/26, 20 B; 126/247; 60/618; 62/52, 53; 123/41.01, 41.3, 41.42, 41.44

[56] References Cited

U.S. PATENT DOCUMENTS

| | | | |
|---|---|---|---|
| 1,107,368 | 8/1914 | Semmler | 237/12.1 |
| 1,326,248 | 3/1916 | Heylandt . | |
| 1,394,955 | 1/1922 | Von Recklinghausen . | |
| 1,521,385 | 1/1926 | Messer . | |
| 1,678,670 | 2/1926 | Crawford . | |
| 1,930,731 | 10/1933 | Thompson . | |
| 1,943,059 | 1/1934 | Dana . | |
| 2,028,119 | 11/1936 | Boshkoff . | |
| 2,035,396 | 3/1936 | Mesinger . | |
| 2,040,059 | 5/1936 | Mesinger . | |
| 2,089,428 | 8/1937 | Ross et al. . | |
| 2,234,901 | 3/1941 | Jones . | |
| 2,308,122 | 1/1943 | St. Clair . | |
| 2,319,971 | 5/1943 | Bodine, Jr. . | |
| 2,343,727 | 3/1944 | Zenner . | |
| 2,359,219 | 9/1944 | Jones . | |
| 2,362,968 | 10/1944 | Bliss et al. . | |
| 2,363,960 | 11/1944 | Hansen . | |
| 2,400,037 | 5/1946 | Arndt et al. . | |
| 2,443,724 | 6/1948 | Cibulka . | |
| 2,446,498 | 8/1948 | Underwood . | |
| 2,490,462 | 4/1950 | Cooper . | |
| 2,525,874 | 7/1950 | Larzelere . | |
| 2,539,291 | 1/1951 | Williamson et al. . | |
| 2,548,051 | 4/1951 | Peck . | |
| 2,576,984 | 12/1951 | Wildhack . | |
| 2,576,985 | 12/1951 | Wildhack . | |
| 2,645,906 | 7/1953 | Ryan . | |
| 2,694,528 | 11/1954 | Ricks et al. . | |
| 2,705,872 | 4/1955 | Thompson . | |
| 2,729,203 | 1/1956 | Prendergast . | |
| 2,748,570 | 6/1956 | Booth . | |
| 2,752,758 | 7/1956 | Tann . | |
| 2,761,286 | 9/1956 | Billue et al. . | |
| 2,795,937 | 6/1957 | Sattler et al. . | |

(List continued on next page.)

FOREIGN PATENT DOCUMENTS

| | | | |
|---|---|---|---|
| 153491 | 10/1953 | Canada | 122/26 |
| 2002057A | of 0000 | United Kingdom . | |

*Primary Examiner*—Albert J. Makay
*Assistant Examiner*—Henry Bennett
*Attorney, Agent, or Firm*—Lucian Wayne Beavers; James R. Duzan; Thomas R. Weaver

[57] ABSTRACT

A flameless nitrogen vaporizing unit includes a first internal combustion engine driving a nitrogen pump through a transmission. A second internal combustion engine drives three hydraulic oil pumps against a variable back pressure so that a variable load may be imposed upon the second engine. Liquid nitrogen is pumped from the nitrogen pump driven by the first engine into a first heat exchanger where heat is transferred from exhaust gases from the first and second internal combustion engines to the liquid nitrogen to cause the nitrogen to be transformed into a gaseous state. The gaseous nitrogen than flows into a second heat exchanger where it is superheated by an engine coolant fluid to heat the gaseous nitrogen to essentially an ambient temperature. The superheated nitrogen is then injected into the well. The engine coolant fluid flows in a coolant circulation system. Heat is transferred to the coolant fluid directly from the internal combustion engine. Heat is also provided to the coolant fluid from lubrication oil pumped by the three pumps attached to the second internal combustion engine. The coolant fluid circulating system includes a comingling chamber for comingling warmer coolant fluid flowing from the internal combustion engines to the second heat exchanger with cooler coolant fluids flowing from the second heat exchanger to the internal combustion engines. Methods of vaporizing nitrogen are also disclosed.

62 Claims, 10 Drawing Figures

U.S. PATENT DOCUMENTS 2,823,521 2/1958 Enger et al. .
2,833,121 5/1958 Dorf .
2,907,176 10/1959 Tsunoda et al. .
2,922,289 1/1960 Freeman, Jr. .
2,937,504 5/1960 Riediger .
2,960,839 11/1960 Hoag .
2,975,607 4/1961 Bodle .
2,983,107 5/1961 Forrest .
2,984,989 5/1961 Garbarini .
3,001,374 9/1961 Hutton, Jr. .
3,012,408 12/1961 Perkins et al. .
3,018,634 1/1962 Gilmore .
3,031,857 9/1961 Walbaum .
3,058,317 9/1961 Putman .
3,059,440 10/1961 Loporto .
3,059,441 10/1961 Werner .
3,068,659 11/1961 Marshall, Jr. .
3,069,863 11/1961 Dolphin et al. .
3,070,968 11/1961 Gardner .
3,077,745 12/1961 Grantham et al. .
3,082,690 12/1961 Reynolds et al. .
3,091,096 12/1961 Rendos et al. .
3,100,525 12/1961 Smith et al. .
3,100,528 3/1963 Plummer et al. .
3,106,956 3/1963 Smith et al. .
3,124,940 3/1964 Guelton .
3,135,099 6/1964 Holm .
3,153,439 10/1964 Golden .
3,154,928 11/1964 Harmens .
3,183,678 5/1965 Hosford .
3,215,315 11/1965 Graeber, Jr., et al. .
3,225,552 12/1965 Farkas .
3,229,472 3/1966 Beers .
3,246,634 4/1966 Stevens .
3,266,261 8/1966 Anderson .
3,269,385 8/1966 Mitchell et al. .
3,293,871 12/1966 Tyree, Jr. .
3,304,730 2/1967 Gorham .
3,319,435 5/1967 Boyd et al. .
3,332,254 9/1967 Elovic et al. .
3,343,387 10/1967 Kuhlmann .
3,397,543 8/1968 Ergenc .
3,407,787 10/1968 Golden .
3,417,563 12/1968 Loprete .
3,421,574 1/1969 Kals .
3,435,623 4/1969 Tyree, Jr. .
3,438,216 4/1969 Smith .
3,446,029 5/1969 Grgurich et al. .
3,452,548 7/1969 Pitaro .
3,475,916 11/1969 Smith .
3,477,412 11/1969 Kitrilakis .
3,479,832 11/1969 Sarsten et al. .
3,552,134 1/1971 Arenson .
3,570,261 3/1971 Schwartzman .
3,570,828 3/1971 Cowan .
3,578,753 5/1971 Freeman, Jr. .
3,603,101 9/1971 Sullivan .
3,662,561 5/1972 Schroeder .
3,672,446 6/1972 Tibbetts et al. .
3,707,078 12/1972 Cramer .
3,712,073 1/1973 Arenson .
3,720,057 3/1973 Arenson .
3,724,426 4/1973 Brown .
3,726,101 4/1973 Arenson .
3,727,651 4/1973 Biever .
3,738,353 6/1973 Santoleri .
3,823,568 7/1974 Bijasiewicz et al. .
3,827,247 8/1974 Kojima et al. .
3,844,475 10/1974 Kesterson et al. ..... 236/1 EA
3,851,629 12/1974 Mayr et al. ..... 237/2 B
3,883,322 5/1975 Bivins, Jr. .
3,897,754 8/1975 Jorde .
3,949,565 4/1976 Roop .
3,978,663 9/1976 Mandrin et al. .
4,003,139 1/1977 Van Winkle .
4,031,705 6/1977 Berg .
4,033,135 5/1977 Mandrin .
4,036,028 7/1977 Mandrin .
4,100,757 1/1978 Garland .
4,106,560 3/1978 Lauro .
4,116,016 11/1979 Roop et al. .
4,117,806 12/1979 Manning .
4,131,084 12/1979 Hanson et al. .
4.164.660 8/1979 Palazzetti ..... 237/12.3 B
4,170,115 2/1980 Ooka et al. .
4,197,712 3/1980 Zwick et al. .
4,201,191 5/1980 Zink et al. .
4,203,300 5/1980 Hanson et al. .
4,213,501 7/1980 Pfeiffer et al. .
4,219,725 8/1980 Groninger .
4,224,802 9/1980 Ooka .
4,226,605 10/1980 Van Don .
4,264,826 4/1981 Ullmann ..... 122/26

FLAMELESS NITROGEN SKID UNIT

The present invention relates generally to apparatus for heating fluids, and more particularly, but not by way of limitation, to a flameless heater adapted for superheating liquid nitrogen for use in gel fracturing operations on offshore oil and gas wells.

Numerous operations are performed on oil and gas wells which require large volumes of nitrogen gas. These operations may be performed on both onshore and offshore wells. Such operations include foam fracturing operations, acidizing services, jetting down the tubing or down the tubing-casing annulus, nitrogen cushions for drill stem testing, pressure testing, insulation of the tubing-casing annulus to prevent such problems as paraffin precipitation, jetting with proppant for perforating and cutting operations, reduction of density of well workover fluids, displacement of well fluid from tubing during gun perforation operations to prevent excess hydrostatic pressure in the hole from pushing perforation debris into the formation, placing corrosion inhibitors by misting the inhibitor with nitrogen, extinguishing well fires, and other operations. The present invention may be utilized with any of these operations.

One particular such operation with relation to which the following disclosure is made is the fracturing of a subsurface formation of the well by pumping a fluid under very high pressure into the formation. The fracturing fluid which is pumped into the well often comprises a foamed gel which is produced by the use of nitrogen gas.

The nitrogen for the foam fracturing operation is generally stored in a liquid form at temperatures of approximately −320° F.

For pressures encountered in these foam fracturing operations, the nitrogen changes state from a liquid to a gas at approximately −200° F. It is, therefore, desirable to heat up the nitrogen gas to a superheated state so that the foam fracturing fluid being pumped down the well will be at an essentially ambient temperature. This is because of the numerous adverse affects upon mechanical equipment of very low temperature which would otherwise be presented by the nitrogen foam.

For land based wells, the nitrogen heating equipment generally includes open flame heaters. A further problem is however, presented when performing foam fracturing operations on offshore wells. For safety and environmental reasons, open flames are not generally allowed on an offshore drilling platform. Therefore, it is necessary to provide a heater or the nitrogen which does not have an open flame.

Such flameless nitrogen heaters have previously been provided by utilizing the heat generated by an internal combustion engine and mechanical components driven thereby to heat a coolant fluid which transferred that heat to the nitrogen through a coolant fluid-to-nitrogen heat exchanger.

One such prior art device is manufactured by the Zwick Energy Research Organization, Inc. of Santa Ana, Calif. The Zwick apparatus includes a single internal combustion engine which drives a hydraulic pump to produce hydraulic fluid under pressure which in turn drives a hydraulically powered nitrogen pump.

The Zwick apparatus uses a single coolant-to-nitrogen heat exchanger means for vaporizing the liquid nitrogen. Zwick does not include a second heat exchanger for transferring heat directly from engine exhaust gases to the nitrogen.

The coolant system of the Zwick device circulates the coolant fluid first through a hydraulic oil-to-coolant heat exchanger where heat from the hydraulic system of the engine and the components driven thereby are transferred to the coolant. Then, the coolant fluid stream splits into two parallel portions, one of which flows through the engine block to absorb heat from the engine and the other of which flows through a manifold surrounding the engine exhaust for absorbing heat from the engine exhaust into the coolant fluid. After the two streams pass through the engine block and the exhaust cooling manifolds, they once again merge into a single stream which is directed to the coolant fluid-to-nitrogen vaporizer. From the vaporizer the fluid returns to the hyraulic oil cooler thereby completing the loop.

With regard to the nitrogen flow system of Zwick, the nitrogen flows from the nitrogen pump through the coolant-to-nitrogen heat exchanger and then to the well head. A bypass is provided around the coolant-to-nitrogen heat exchanger by means of which liquid nitrogen can be bypassed around the coolant-to-nitrogen heat exchanger to aid in controlling the temperature of the nitrogen gas being injected into the well.

The load on the single internal combustion engine of Zwick may be varied by varying the back pressure on the hydraulic pump driven by the engine.

Another prior art flameless nitrogen heating unit is manufactured by Airco Cryogenics, a division of Airco, Inc. of Irvine, Calif.

The Airco device also uses a single internal combustion engine driving a hydraulic pump which produces hydraulic fluid under pressure for driving a liquid nitrogen pump.

The Airco device utilizes air as the heat exchange medium for transferring heat to the liquid nitrogen to varporize the same. This is accomplished in the following manner. A large plenum chamber is provided into which ambient air is drawn. Disposed in the plenum chamber in heat exchange contact with the air flowing therethrough is a hydraulic oil-to-air heat exchanger wherein hydraulic fluid heated by the engine and its various operating components is circulated through the hydraulic oil-to-air heat exchanger to heat the air.

An engine coolant fluid-to-air heat exchanger, i.e., the engine radiator, is also disposed in the plenum chamber for transferring heat energy from the engine coolant system to the air flowing through the plenum chamber.

Additionally, the exhaust gases produced by the internal combustion engine are dumped directly into the plenum chamber to mix with the air flowing therethrough.

The air flowing through the plenum chamber, after it has been heated by the hydraulic oil-to-air cooler and the engine radiator and after it has mixed with engine exhaust gases, then passes over an air-to-nitrogen heat exchanger wherein heat energy is transferred from the hot air to the liquid nitrogen to vaporize the same.

The load imposed upon the internal combustion engine of the Airco device may be varied by varying the pressure in the vaporized nitrogen discharge line to raise the pressure against which the nitrogen pump is working and in turn raise the load on the hydraulic pump driven by the internal combustion engine which in turn increases the load on the internal combustion engine.

Numerous problems are encountered with the Airco type device mainly because of the use of air as a heat transfer medium. Air is a notoriously poor heat transfer medium as compared to a liquid and the use of ambient air causes the system to be very much depenent upon ambient air conditions for proper operation. Additionally, due to the large bulky nature of the plenum chamber required for the use of air as a heat transfer medium, the Airco system is very much larger than a system like that of the present invention of equal capacity.

Thus, it is seen that the prior art has recognized the need for a flameless nitrogen vaporizer. The devices of this type included in the prior art, however, have numerous shortcomings particularly with regard to their capability of providing sufficient heat for vaporizing large volumes of nitrogen and with regard to their capability of accurately controlling the amount of heat transferred to the nitrogen and its corresponding temperature as it enters the well head.

The flameless nitrogen vaporizing unit of the present invention greatly improves upon the prior art devices by providing a second internal combustion engine for the sole purpose of providing additional heat for the vaporization of the nitrogen. This second internal combustion engine and its associated heat transfer system are so interconnected with a first internal combustion engine and its associated heat transfer system so that the first internal combustion engine may be used alone for nitrogen production at rates for which sufficient heat may be generated by a single engine for the vaporization thereof, and then for higher rates the second internal combustion engine can be activated and its heat transfer system working in conjunction with that of the first internal combustion engine provides a total heat transfer sufficient for vaporizing nitrogen at these higher rates and superheating it to essentially ambient conditions. Numerous refinements in the load control systems and temperature control systems as connected to each of the two internal combustion engines are provided also.

The flameless nitrogen vaporizing unit of the present invention includes a first internal combustion engine driving a nitrogen pump through a transmission. Connected to the transmission is a transmission retarder for varying the load on the first internal combustion engine by varying a level of hydraulic fluid present in the transmission retarder. A second internal combustion engine drives three hydraulic oil pumps against a variable back pressure so that a variable load may be imposed upon the second engine.

Liquid nitrogen is pumped from the nitrogen pump driven by the first engine into a first heat exchanger where heat is transferred from exhaust gases from the first and second internal combustion engines to the liquid nitrogen to cause the nitrogen to be transformed into a gaseous state. The gaseous nitrogen then flows into a second heat exchanger where it is superheated by an engine coolant fluid to heat the gaseous nitrogen to essentially an ambient temperature. The superheated nitrogen is then injected into the well.

The engine coolant fluid flows in a coolant circulation system wherein it receives heat from several sources. Heat is transferred to the coolant fluid directly from the internal combustion engines. Heat is transferred to the coolant fluid from transmission fluid which flows through the transmission of the first internal combustion engine and the transmission retarder thereof. Heat is also provided to the coolant fluid from lubrication oil pumped by the three pumps attached to the second internal combustion engine. In an alternative embodiment these three pumps and their related oil to coolant heat exchanger are replaced by a water brake dynamometer which pumps the coolant fluid. The coolant fluid circulating system includes a comingling chamber for comingling warmer coolant fluid flowing from the internal combustion engines to the coolant fluid-to-nitrogen heat exchanger with cooler coolant fluid flowing from the coolant fluid-to-nitrogen heat exchanger to the internal combustion engines. This aids in controlling the temperatures of the internal combustion engines to prevent overcooling of the same.

Numerous features and advantages of the present invention will be readily apparent to those skilled in the art upon a reading of the following disclosure when taken in conjunction with the accompanying drawings.

Figure 1:
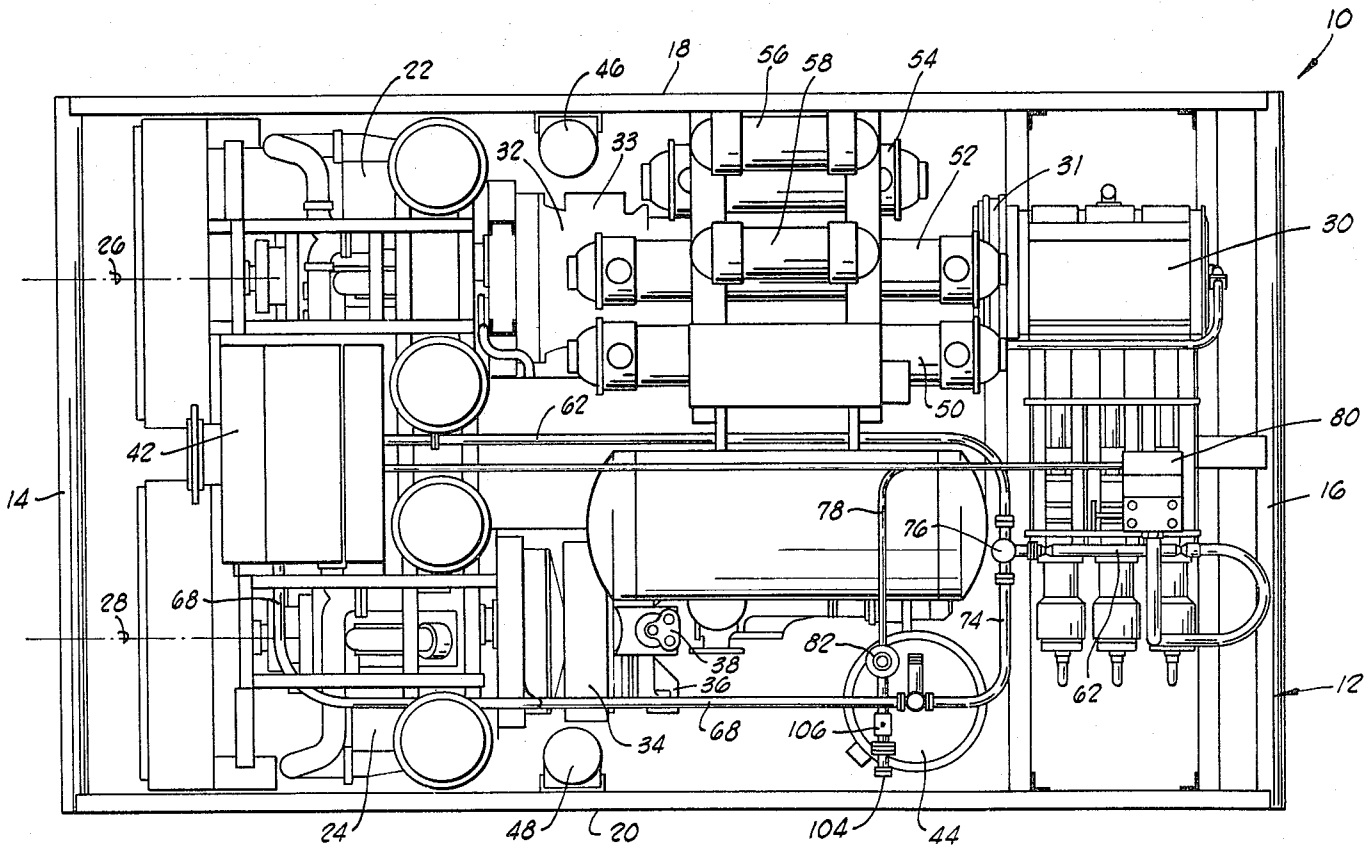
FIG. 1 is a plan view of the flameless nitrogen unit of the present invention.
Figure 2:
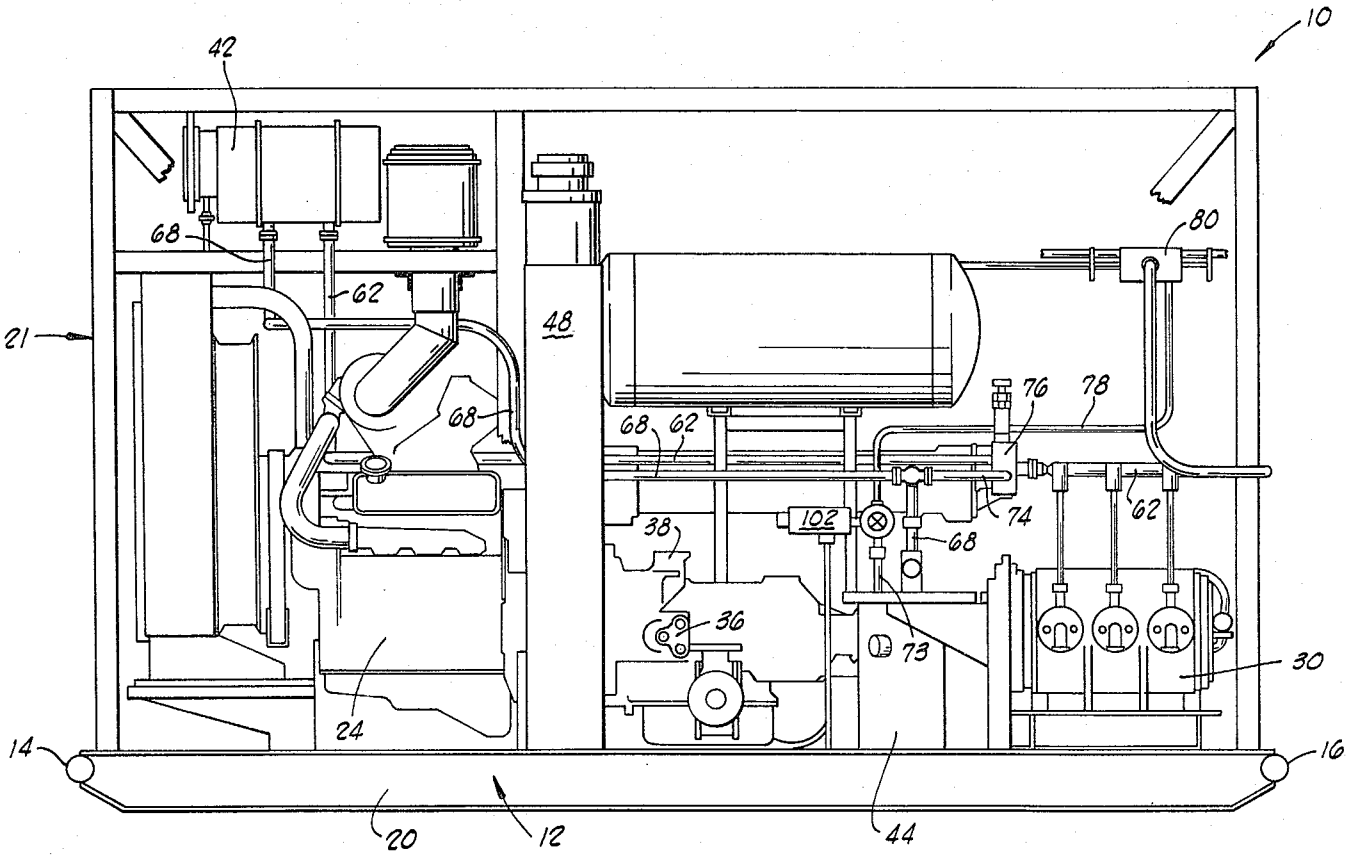
FIG. 2 is a left side elevation view of the apparatus of FIG. 1.

Referring now to the drawings and particularly to FIGS. 1 and 2, the flameless nitrogen vaporizing unit of the present invention is shown and generally designated by the numeral 10. The vaporizing unit 10 may generally be referred to as an apparatus for heating a first fluid, said fluid being the liquid nitrogen.

The apparatus 10 includes a rectangular transportable skid frame 12 having first and second opposed sides 14 and 16, and having third and fourth opposed sides 18 and 20. The first and second sides 14 and 16 define a width of frame 12, which width is approximately 95 inches in a preferred embodiment. The third and fourth sides 18 and 20 define a length of frame 12 which length is approximately 168 inches in a preferred embodiment.

The vaporizing apparatus 10 is surrounded by a protective cage 21 which, in a preferred embodiment, has a height of 96 inches. The protective cage 21 is not shown in FIG. 1 so that the other components may be more clearly illustrated.

Mounted upon the frame 12 are first and second internal combustion engines 22 and 24, respectively, which may also be referred to as first and second power sources. In a preferred embodiment, engines 22 and 24 are General Motors 6V-92T diesel engines. Engines 22 and 24 are oriented upon frame 12 so that the respective axes of rotation, 26 and 28, of the crank shafts of engines 22 and 24 are oriented substantially parallel to third and fourth sides 18 and 20 of frame 12.

A compressed air system is provided on the apparatus 10 with an air compressor driven by first engine 22 connected to a compressed air storage tank for use with compressed air driven starters on the engines 22 and 24.

A nitrogen pump 30, which may also be referred to as a main pump, is located on frame 12 between the first engine 22 and second side 16 of frame 12. In a preferred embodiment pump 30 is preferably a Halliburton HT-150 positive displacement pump having Linde HP-60 fluid ends.

Nitrogen pump 30 is drivingly connected to first engine 22 by transmission means 32 and by a gear reduction box 31. In a preferred embodiment transmission 32 is an Allison HT-750 transmission, and gear reduction box 31 provides a 5-to-1 gear reduction between transmission 32 and pump 30.

The transmission 32 is equipped with a hydraulic transmission retarder 33 of a design well known to those skilled in the art which operates in a manner similar to that of a torque convertor with a load exerted on the transmission by the transmission retarder being dependent upon a controllable level of a transmission fluid present in the transmission retarder. The higher the fluid level in the retarder is, the higher the load exerted will be.

The second engine 24 has a triple pump drive unit 34 attached to the rear end thereof to which are drivingly connected first, second and third hydraulic pumps 36, 38 and 40, two of which can be seen in FIG. 1.

The exhaust systems from engine 22 and 24 are connected to an exhaust gas-to-nitrogen heat exchanger 42 which is located between and above the engines 22 and 24 as shown in FIGS. 1 and 2. The exhaust heat exchanger 42 is a means for transferring heat energy from the exhaust gases produced by engines 22 and 24 directly to the nitrogen flowing through the tube side of exchanger 44. The term "directly" is used to indicate that the heat energy is not passed through any intermediate heat transfer fluid medium between the exhaust gas and the nitrogen.

A coolant fluid-to-nitrogen heat exchanger 44 is located behind second engine 24 near the fourth side 20 of frame 12, for transferring heat from the coolant fluid directly to the nitrogen.

First and second coolant fluid comingling chambers 46 and 48 are located near third and fourth sides 18 and 20, respectively, of frame 12 just to the rear of first and second engines 22 and 24, respectively.

Located above transmission 32 are a plurality of heat exchangers for transferring heat energy from various sources on the apparatus 10 to the engine coolant fluid which circulates through the cooling systems of the engines 22 and 24. These heat exchangers include the following.

First and second hydraulic system coolers 50 and 52, respectively, are provided for transferring heat energy from a hydraulic fluid pumped by pumps 36, 38 and 40 to the coolant fluid. Hydraulic coolers 50 and 52 may also be referred to as hydraulic fluid-to-coolant fluid heat exchangers.

A transmission cooler 54 is provided for transferring heat energy from the transmission fluid circulating through transmission 32, and its associated transmission retarder 33, to the coolant fluid.

First and second nitrogen pump coolers 56 and 58, respectively, are provided for transferring heat energy from a lubricating fluid circulating through nitrogen pump 30 to the coolant fluid. Nitrogen pump coolers 56 and 58 may also be referred to as nitrogen pump lubricating fluid-to-coolant fluid heat exchangers.

Figure 3:
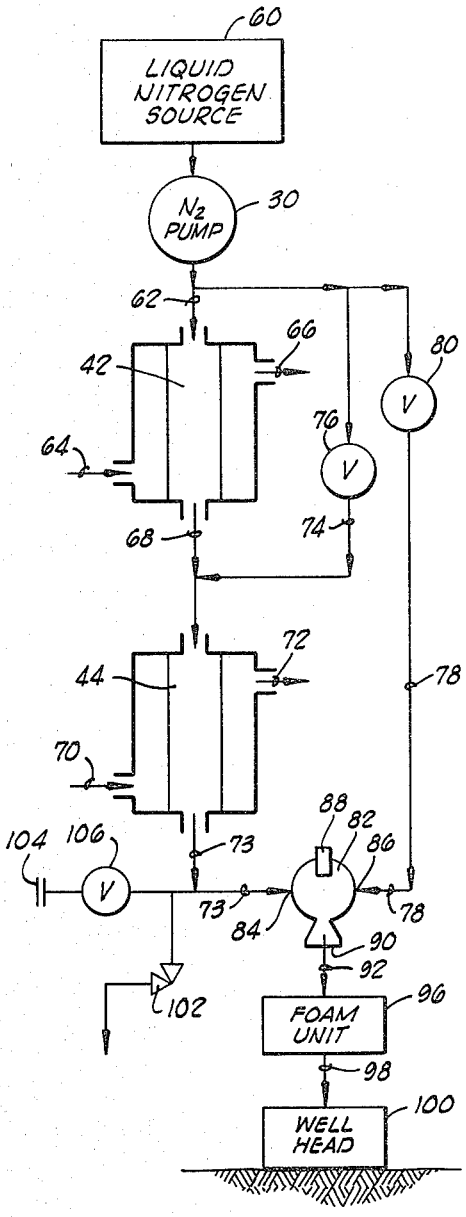
FIG. 3 is a schematic representation of the nitrogen flow system.

Referring now to FIG. 3, a schematic flow diagram is shown for the nitrogen system of the nitrogen heating apparatus 10. The nitrogen pump 30 takes liquid nitrogen from a liquid nitrogen source 60 which, in a preferred embodiment, has a capacity of approximately 2,000 gallons. The liquid nitrogen source 60 is not located on frame 12. A discharge line 62 connects the discharge of nitrogen pump 30 to the tube side of exhaust heat exchanger 42.

Hot exhaust gases from engines 22 and 24 are passed through the shell side of exchanger 42 as indicated by arrows 64 and 66.

The liquid nitrogen from pump 30 enters exhaust heat exchanger 42 at a temperature of approximately −320° F. The heat supplied by exhaust exchanger 42 is approximately sufficient to vaporize the nitrogen and the vaporized nitrogen exits exhaust exchanger 42 by means of conduit 68 at a temperature of approximately −200° F.

Figure 4:
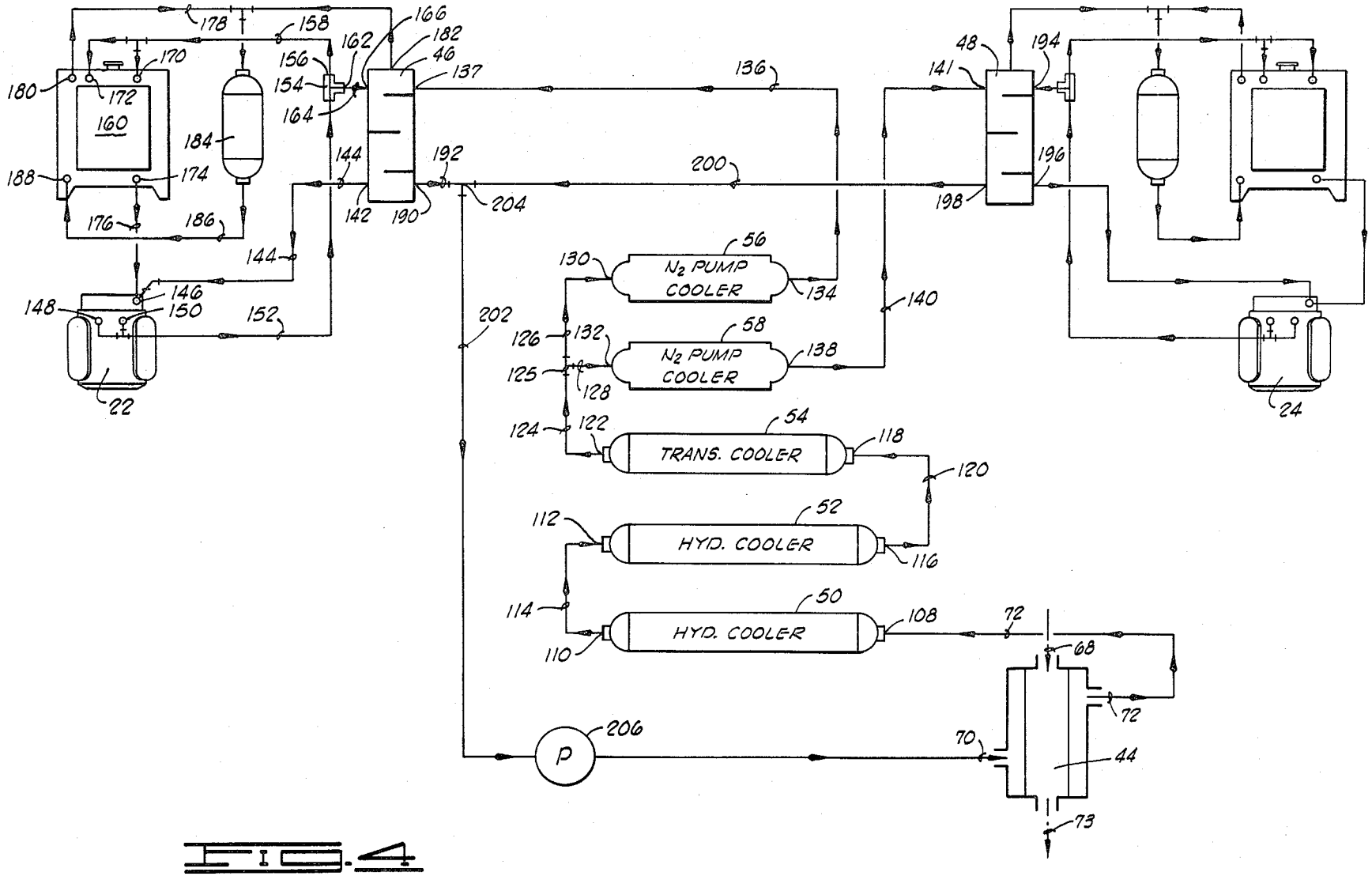
FIG. 4 is a schematic representation of the coolant flow circulating system.

Conduit 68 directs the vaporized nitrogen into the tube side of coolant fluid-to-nitrogen heat exchanger 44. Warm coolant fluid from the system generally shown in FIG. 4 is passed through the shell side of exchanger 44 as indicated by arrows 70 and 72. The heat transferred from the coolant fluid to the vaporized nitrogen in coolant fluid heat exchanger 44 superheats the vaporized nitrogen to approximately ambient temperatures of 70° F. ±20° F. at conduit 73 exiting exchanger 44.

As is shown in FIG. 3, the exhaust heat exchanger 42 and the coolant heat exchanger 44 are so arranged relative to the direction of flow of the nitrogen that the exhaust heat exchanger 42 is located upstream of the coolant heat exchanger 44.

A first bypass conduit means 74 is provided for bypassing liquid nitrogen past exhaust heat exchanger means 42. Disposed in first bypass conduit 74 is a manually operable control valve 76 which provides a means for controlling the amount of liquid nitrogen which is bypassed around exhaust heat exchanger 42 so that a controlled portion of nitrogen is so bypassed.

A second bypass conduit means 78 provides a means for bypassing liquid nitrogen past both the exhaust heat exchanger means 42 and the coolant heat exchanger means 44. Disposed in second bypassing conduit 78 is a manually operable control valve 80, which is a needle valve, by means of which the amount of liquid nitrogen passed through second bypass conduit 78 may be controlled.

The first and second bypass conduit means 74 and 78 are connected in parallel so that the second bypass means 78 is operable independent of first bypass means 74 allowing liquid nitrogen to by bypassed through either one or both of the bypass means.

Discharge conduit 73 from coolant heat exchanger means 44 and second bypass conduit 78 are both connected to a discharge manifold 82.

Figure 6:
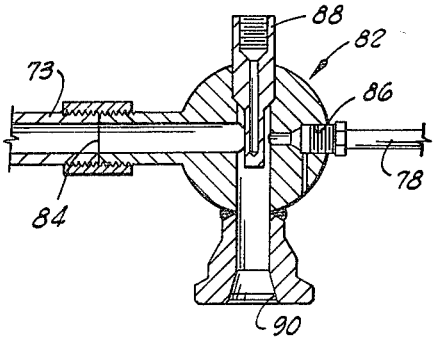
FIG. 6 is a sectional view of the nitrogen vaporizer discharge manifold showing the connection of a bypass line thereto for bypassing liquid nitrogen around both the exhaust gas-to-nitrogen heat exchanger and the coolant fluid-to-nitrogen heat exchanger.

Discharge manifold 82 is shown in section in FIG. 6. Discharge manifold 82 includes a first inlet 84 to which is connected conduit 73, and a second inlet 86 to which is connected bypass conduit 78.

A thermowell 88 is disposed in manifold 82 so that a temperature indicating means (not shown) may be connected thereto to measure the temperature of the superheated nitrogen which is discharged from manifold 82 through outlet 90 thereof. The outlet 90 is connected to a nitrogen discharge line 92 which directs the superheated nitrogen vapors to a foaming unit 96 where the nitrogen gas is used to produce the fracturing gel solution which is in turn directed through a conduit 98 to the well head 100 of the well which is being treated.

Connected to the conduit 73 between coolant heat exchanger means 44 and discharge manifold 82 is a safety relief valve 102 and an access flange 104 adjacent an access valve 106.

Referring now to FIG. 4, there is thereshown a schematic flow diagram for the coolant fluid which flows through the shell side of coolant fluid heat exchanger 44 as indicated by arrows 70 and 72 on FIG. 3.

In FIG. 4, coolant fluid-to-nitrogen heat exchanger means 44 is shown schematically in a manner similar to that in which it is shown in FIG. 3. Conduits leading into and out of the shell side of exchanger 44 are designated by numerals 70 and 72, respectively, corresponding to the arrows 70 and 72 of FIG. 3. The warm coolant fluid enters heat exchanger 44 through conduit 70 and in the exchanger 44 transfers heat to the nitrogen flowing through the tube side of exchanger 44, as indicated by arrows 68 and 73 shown in phantom lines, and a cooler coolant fluid exits exchanger 44 by means of conduit 72.

The other end of conduit 72 is attached to a tube side inlet 108 of hydraulic cooler 50. A tube side outlet 110 of hydraulic cooler 50 is connected to a tube side inlet 112 of second hydraulic cooler 52 by a conduit 114.

A tube side outlet 116 of second hydraulic cooler 52 is connected to a tube side inlet 118 of transmission cooler 54 by conduits 120. A tube side outlet 122 of transmission cooler 54 is connected to a conduit 124 which in turn is connected to hydraulically parallel conduit 126 and 128 leading to tube side inlets 130 and 132 of first and second nitrogen pump coolers 56 and 58, respectively.

A tube side outlet 134 of first nitrogen pump cooler 56 is connected to a first inlet 137 of first comingling chamber 46 by a conduit 136. A tube side outlet 138 of second nitrogen pump cooler 58 is connected to a first inlet 141 of second comingling chamber 48 by a conduit 140.

Figure 7:
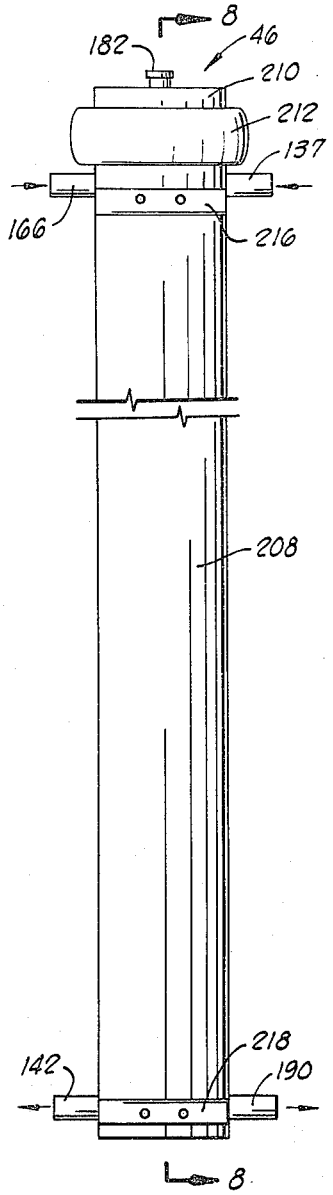
FIG. 7 is an elevation view of one of the coolant fluid comingling chambers.
Figure 8:
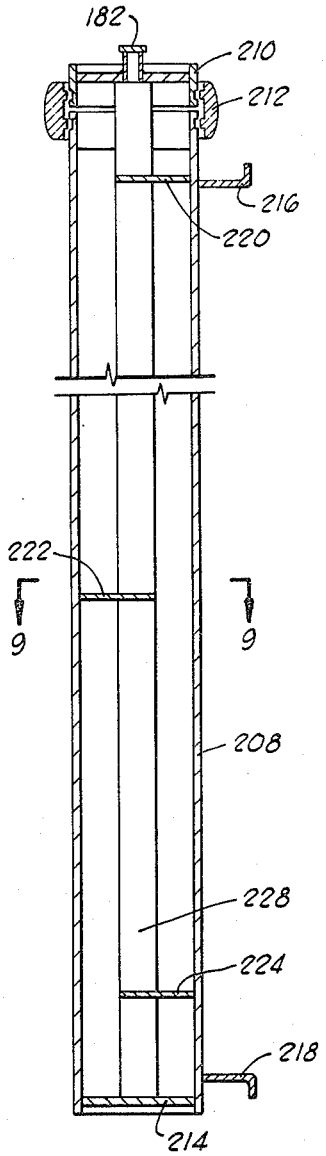
FIG. 8 is a sectional elevation view along line 8—8 of FIG. 7.
Figure 9:
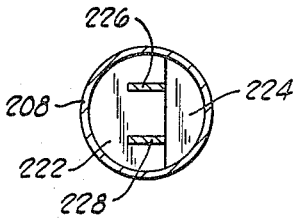
FIG. 9 is a horizontal section view about line 9—9 of FIG. 8.

The details of construction of comingling chambers 46 and 48 are shown in detail in FIGS. 7–9.

Coolant fluid exits a first outlet 142 of comingling chamber 46 through a conduit 144. The other end of conduit 144 is connected to an inlet 146 to the water jacket of first engine 22. The coolant fluid then flows through the water jacket of engine 22 and exits the water jacket at outlets 148 and 150. A conduit 152 is connected at one end to outlets 148 and 150 and at the other end to a three-way thermostatically controlled valve 154.

A first outlet 156 of valve 154 is connected to a conduit 158 for directing coolant fluid to a radiator 160. A second outlet 162 of valve 154 is connected to a conduit 164 for directing coolant fluid to a second inlet 166 of first comingling chamber 146.

Depending upon the temperature of the coolant fluid entering thermostatically controlled valve 154, the coolant fluid is directed to one of first and second outlets 156 or 162. If the coolant fluid is too hot it is directed to first outlet 156 and to conventional radiator 160 where the coolant fluid is cooled by heat exchange with air flowing past the outside of radiator 160. Otherwise, the coolant fluid is directed to second outlet 162 and directly to second inlet 166 of first comingling chamber 146.

The coolant fluid directed through conduit 158 to radiator 160 enters the tube side of radiator 160 through inlets 170 and 172.

That coolant fluid then exits a tube side outlet 174 of radiator 160 and is directed to inlet 146 of the water jacket of first engine 22 by a conduit 176.

An overflow conduit means 178 is connected to an overflow outlet 180 of radiator 160 and an overflow outlet 182 of first comingling chamber 46. Overflow conduit 178 is connected to a first surge tank 184 from which a coolant fluid make-up conduit 186 directs coolant fluid to a make-up inlet 188 of first radiator 160. Surge tank 184 serves to de-aerate the coolant fluid and provide make-up fluid.

All of the coolant fluid which flows from first comingling chamber 46 through conduit 144 to the engine 22, or which is recycled through the radiator 160 and then back to the engine 22, eventually returns through the conduit 164 to the second inlet 166 of comingling chamber 46 as previously described. The coolant fluid entering second inlet 166 which has just been heated by the first engine 22 is physically mixed with or comingled with the cooler coolant fluid entering first inlet 137 within the comingling chamber 46.

A portion of this comingled coolant fluid is that which was previously described as exiting first outlet 142 of comingling chamber 46. A second portion of the comingled coolant fluid within the chamber 46 exits second outlet 190 of comingling chamber 46 by means of conduit 192.

The temperature of the coolant fluid entering first inlet 137, in a preferred embodiment, is approximately 160° to 170° F. The temperature of the coolant fluid entering second inlet 166 is approximately 190° F. The temperature of the coolant fluid exiting first and second outlets 142 and 190 is approximately 180° F. for each outlet.

The comingling chamber 46 serves to raise the temperature of the coolant fluid directed to the coolant system of first engine 22 higher than it would be if the comingling chamber 46 were eliminated and the conduit 136 were connected directly to the conduit 144. This helps prevent over-cooling of the first engine 22 and prevents the mechanical problems which can arise as a natural consequence of over-cooling an internal combustion engine.

The entire system shown in FIG. 4 may generally be referred to as a coolant system means.

The various conduits which return the coolant fluid from engines 22 and 24 to the heat exchanger 44 may generally be described as a first coolant fluid conducting means, and the various conduits conducting coolant fluid from coolant fluid heat exchanger 44 to the first and second engines 22 and 24 may generally be described as a second coolant fluid conducting means.

All of the various heat exchangers, comingling chambers, radiators, surge tanks, pumps and the like shown in FIG. 4 may generally be described as being disposed in one of these first or second coolant fluid conducting means.

The second coolant fluid conducting means supplying fluid from exchanger 44 to the engines 22 and 24 splits into two parallel streams at the tee 125. The two parallel streams are again combined at the tee 204 in the first coolant fluid conducting means. The first and second engines 22 and 24 may therefore, be said to be connected in parallel between the first and second coolant fluid conducting means, so that the coolant fluid flowing from the second coolant fluid conducting means to the first coolant fluid conducting means is split into first and second coolant fluid streams flowing past said first and second internal combustion engines 22 and 24, respectively.

The comingling chambers 46 and 48 may each be generally referred to as a transfer means, connected to the first and second coolant fluid conducting means between the engines 22 and 24 and the heat exchanger means 44, for transferring heat energy from coolant fluid in the first coolant fluid conducting means to coolant fluid in the second coolant fluid conducting means.

The comingling chamber 46 could be replaced by a more conventional heat exchanger which does not mix the fluid flowing to and from engine 22, but due to the fact that the fluids are identical and the temperature differential is small the comingling chamber is preferred because it provides a much larger heat exchange than would a conventional shell and tube exchanger of similar physical size.

The conduits connecting second comingling chamber 48 with second engine 24 are similar to that just described between first comingling chamber 46 and first engine 22.

The second comingling chamber 48 includes the first inlet 141 and a second inlet 194. It also includes first and second outlets 196 and 198. Second outlet 198 is connected to a conduit 200.

Conduits 192 and 200 returning coolant fluid from comingling chambers 46 and 48 both connect to a common return line 202 at a tee connection 204.

Return conduit 202 is connected to a suction side of a coolant fluid pump 206. The discharge side of coolant fluid pump 206 is connected to the conduit 70 which has previously been described as connected to the inlet of the shell side of coolant fluid heat exchanger 44. Pump 206 is a hydraulically powered pump which is driven by a hydraulic motor.

Although not illustrated in FIG. 4, it is desirable to conduct a smaller portion of the flow of warm coolant fluid from the discharge of pump 206 through a heating jacket around the fluid end of nitrogen pump 30 to heat the same.

The details of construction of comingling chamber 46 are shown in FIGS. 7–9. Second comingling chamber 48 is similarly constructed. FIG. 7 is an outer elevation view of comingling chamber 46.

Comingling chamber 46 includes a vertically oriented cylindrical housing 208 to which the inlets 137 and 166 and the outlets 142 and 190 are connected.

A cap 210 is connected to the upper end of housing 208 by a locking collar 212. The overflow outlet 182 is attached to cap 210.

Referring now to FIG. 8 a sectional elevation view about line 8—8 of FIG. 7 is thereshown. A base plate 214 seals the lower end of cylindrical housing 208. First and second mounting brackets 216 and 218 are attached to the outer surface of housing 208 for attaching the same to the frame 12 of the flameless nitrogen vaporizing unit 10.

Inside the housing 208 are first, second and third baffles 220, 222 and 224.

As is best shown in FIG. 9 which is a horizontal section view along line 9—9 of FIG. 8, the baffles are attached to two central vertically oriented parallel support legs 226 and 228 which set in rectangular cut-out spaces in the baffles. The baffles are attached to the support legs 226 and 228 by welding or other suitable means.

The operation of the comingling chamber 46 is as follows. The cooler coolant fluid enters first inlet 137 and the warmer coolant fluid enters second inlet 166 and the two streams of fluid begin comingling with each other above first baffle 220. As the comingled fluid flows downward through comingling chamber 46 to the outlets 142 and 190, the direction of the fluid is deflected twice by the second and third baffles 222 and 224 to insure thorough mixing or comingling of the two liquid streams so that the liquid exiting the two outlets 142 and 190 is essentially of the same temperature at each of those outlets.

Figure 5:
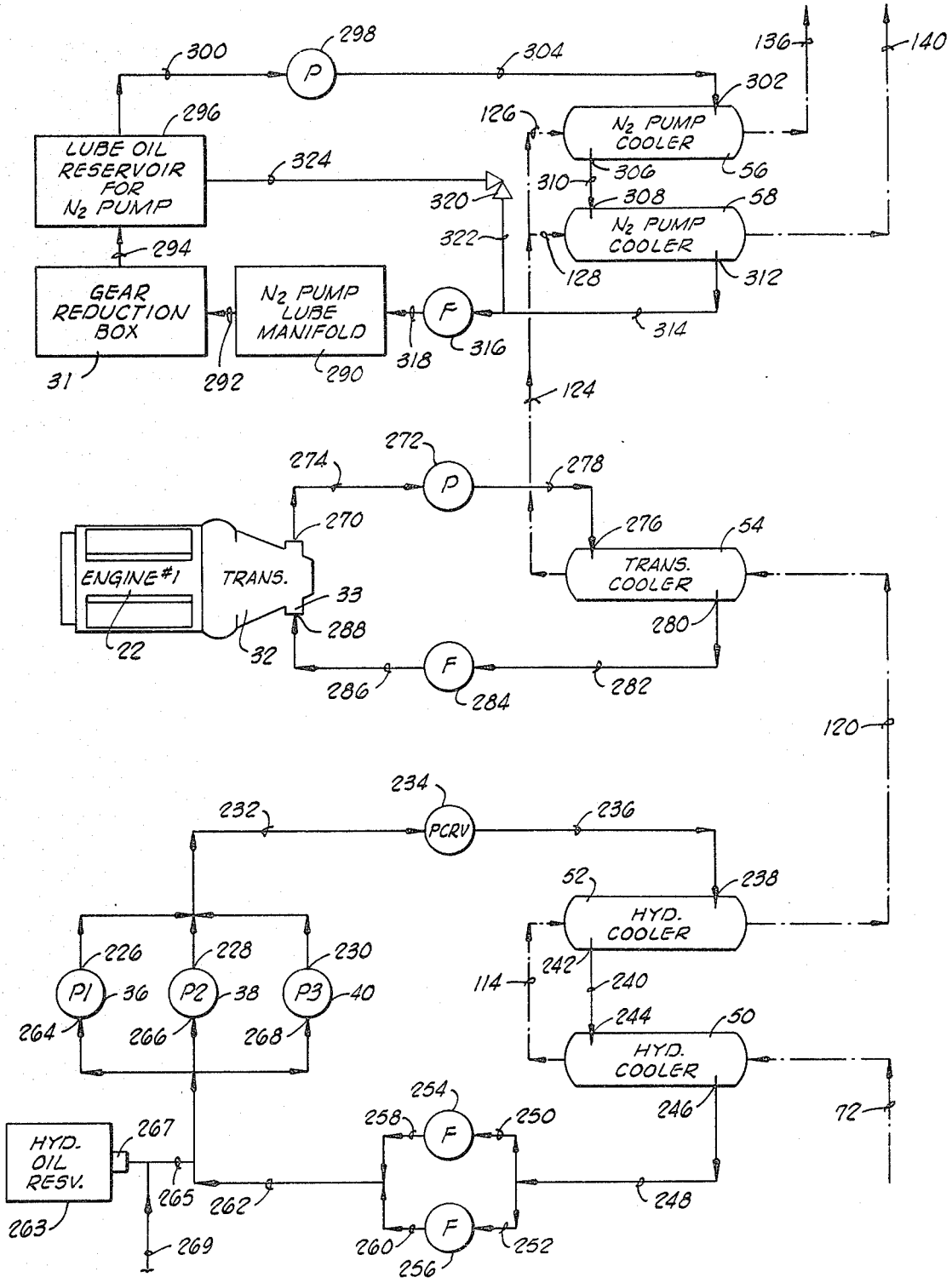
FIG. 5 is a schematic representation of the flow of lube oil from the nitrogen pump to the lube oil-to-coolant fluid exchangers, the flow of the transmission fluid from the transmission to the transmission-to-coolant fluid exchanger, and the flow of hydraulic oil from the three pumps attached to the second internal combustion engine to the hydraulic oil-to-coolant fluid exchangers.

Referring now to FIG. 5, a schematic flow diagram is shown for the shell side fluids of the hydraulic coolers 50 and 52, the transmission cooler 54 and the nitrogen pump coolers 56 and 58. The flow of coolant fluid through the tube sides of those exchangers is represented by phantom lines in a manner similar to that shown in FIG. 4 for aid in correlation of the two drawings.

In the lower portion of FIG. 5, the three hydraulic pumps 36, 38 and 40 which are driven by second engine 22 are thereshown. The discharge sides 226, 228 and 230 of pumps 36, 38 and 40, respectively, are connected to a common discharge line 232. Disposed in discharge line 232 is a pilot controlled relief valve 234 which allows the discharge pressure in discharge line 232 to be controlled and varied. The pilot controlled relief valve 234 includes a relief valve which may be set at the desired operating backpressure for the discharge line 232. The relief valve remains closed for a very short period of time after the positive displacement pumps 226, 228 and 230 have begun operating until the pressure in discharge 232 reaches the preset value at which the relief valve is designed to open. The relief valve opens at that point and maintains a constant backpressure against the pumps 226, 228 and 230 at the preset level.

In a control console (not shown) supported from the frame 12 of flameless nitrogen heating unit 10, there is located an overriding relief valve which is interconnected with pilot controlled relief valve 234 so that the setting of pilot controlled relief valve 234 may be overriden and changed by operation of the relief valve located in the control console.

Heat is generated and transferred to the hydraulic fluid as it is pumped through the pumps 36, 38 and 40 and as it drops across the restriction in pilot controlled relief valve 234.

The pumps 36, 38 and 40 along with pilot controlled relief valve 234 provide a variable load means, connected to second internal combustion engine 24, for exerting a varying load on second internal combustion engine 24, so that an amount of heat energy transferred from engine 24 to the coolant fluid in the system illustrated in FIG. 4, and then from the coolant fluid to the liquid nitrogen in the coolant fluid heat exchanger 44, increases as the load exerted on second internal combustion engine 24 is increased by raising the backpressure controlled by pilot controlled relief valve 234.

A conduit 236 connects pilot controlled relief valve 234 to a shell side inlet 238 of second hydraulic cooler 52. A conduit 240 connects a shell side outlet 242 of second hydraulic cooler 252 with a shell side inlet 244 of first hydraulic cooler 50. A shell side outlet 246 of first hydraulic cooler 50 is connected to a conduit 248.

Conduit 248 is connected to two parallel conduits 250 and 252 which are connected to first and second filters 254 and 256.

The outlets of filters 254 and 256 are connected to conduits 258 and 260 which are connected to a common return conduit 262.

Suction sides 264, 266 and 268 of pumps 36, 38 and 40, respectively, are all connected to the return line 262 thereby completing the circuit for the hydraulic fluid through the shell side of hydraulic coolers 50 and 52.

Return line 262 is connected to a hydraulic oil reservoir 263 by a conduit 265 and a back pressure check valve 267. Another hydraulic fluid return line 269 from a hydraulic motor (not shown) which drives coolant pump 206, see FIG. 4, connects to conduit 265 between check valve 267 and conduit 262.

Back pressure check valve 267 maintains a constant back pressure of 22 psi on conduits 265 and 269. This provides a constant pressure supply of hydraulic fluid to the suction sides of pumps 36, 38 and 40.

Referring now to the middle portion of FIG. 5, the first internal combustion engine 22, the transmission 32 and transmission retarder 33 are there schematically illustrated.

An outlet 270 from transmission 32 and transmission retarder 33 is connected to a suction side of transmission fluid pump 272 by a conduit 274. The discharge from pump 272 is connected to a shell side inlet 276 of transmission cooler 54 by a conduit 278. A shell side outlet 280 of transmission cooler 54 is connected to a conduit 282 the other end of which is connected to a filter 284. The outlet from filter 284 is connected to a return conduit 286 which is connected to an inlet 288 of transmission 32 and transmission retarder 33. The transmission fluid is heated by the friction incurred in the transmission 32 and transmission retarder 33 and that heat is transferred to the coolant fluid by means of transmission cooler 54.

Referring now to the upper portion of FIG. 5, the circulation system for lubricating oil for the nitrogen pump 30 is thereshown. A lubricating oil manifold which distributes lubricating oil to the various moving parts of nitrogen pump 32 is represented schematically by nitrogen pump lube manifold 290. The lubrication oil is heated as it flows through the manifold 290. The lubrication oil from manifold 290 is carried by a conduit 292 to the gear reduction box 31 which was previously described with relation to FIG. 1. The gear reduction box 31 connects transmission 32 to nitrogen pump 30. The lubrication oil is then carried from gear reduction box 31 by a conduit 294 to a lubricating oil reservoir 296.

A lube oil pump 298 has a suction thereof connected to the lube oil reservoir 296 by a conduit 300. A discharge side of pump 298 is connected to a shell side inlet 302 of first nitrogen pump cooler 56 by a conduit 304.

A shell side outlet 306 of first nitrogen pump cooler 56 is connected to a shell side inlet 308 of second nitrogen pump cooler 58 by a conduit 310. A shell side outlet 312 of second nitrogen pump cooler 58 is connected to a conduit 314.

Conduit 314 is connected to an inlet of filter 316. The outlet of filter 316 is connected to the inlet of nitrogen pump lube manifold 290 by a conduit 318, thereby completing the circulating loop for the lube oil.

A safety relief valve 320 is connected to conduit 314 by a conduit 322 and the outlet of relief valve 320 is connected to lube oil reservoir 296 by a conduit 324.

The operation of the flameless nitrogen vaporizing unit 10 is generally as follows.

For relatively low pumping rates of nitrogen, only the first internal combustion engine 22 need be utilized. The engine 22 is started and it drives the nitrogen pump 30 which pumps the nitrogen through the flow system illustrated in FIG. 3. The flow rate of nitrogen pumped by pump 30 is controlled by controlling the speed of engine 22 and by the transmission gearing in transmission 32.

Simultaneously, exhaust gases from the engine 22 flow through the shell side of exhaust heat exchanger 42 and heat the liquid nitrogen. If too much heat is being provided by the exhaust exchanger 42 it may be partially or entirely bypassed by means of bypass conduit 74 and control valve 76.

The nitrogen then flows into coolant fluid heat exchanger 44 where it is further heated by heat transferred from the coolant fluid. Both the exchanger 42 and the coolant fluid exchanger 44 may be bypassed by means of second bypass conduit 78 and control valve 80. By watching the temperature indicated by a temperature indicator (not shown) disposed in thermowell 88, an operator may utilize the valves 76 and 80, primarily the valve 80, for fine adjustment of the temperature of the nitrogen flowing out the outlet 90 of the discharge manifold 82.

A larger but less accurate adjustment of the temperature of the nitrogen can be made by varying the load on transmission retarder 33 so as to vary the load on engine 22 and correspondingly vary the heat generated thereby in the various heat exchange systems. Simultaneously with all of this, of course, heat is transferred from the transmission 32 and transmission retarder 33 to transmission fluid and then to the coolant fluid by means of transmission cooler 54. Also, heat flows in the nitrogen pump lube oil system shown in the upper part of FIG. 5 to the nitrogen pump coolers 56 and 58.

If all the systems connected to the first internal combustion engine 22 are not capable of providing sufficient heat for the vaporization of the desired flow rates of liquid nitrogen, then the second internal combustion engine 24 is activated. The second internal combustion engine 24 is operable independently of first internal combustion engine 22, so that the second internal combustion engine 24 may be selectively used as an auxiliary heat source in addition to first internal combustion engine 22 when the amount of heat energy transferred from the first engine 22 to the coolant fluid is insufficient to provide sufficient heat energy for heating the nitrogen to a desired temperature in the coolant heat exchanger means 44.

Once the second internal combustion engine 24 is activated, the amount of heat provided thereby may be grossly adjusted by varying the back pressure on the pumps 36, 38 and 40 by means of the pilot controlled relief valve 234. The fine temperature adjustment is still provided by the bypass means 78 and control valve 80.

The apparatus 10 provides pumping rates in the overall range of from 15,000 to 230,000 standard cubic feet per hour at a pump pressure of 10,000 psi.

Figure 10:
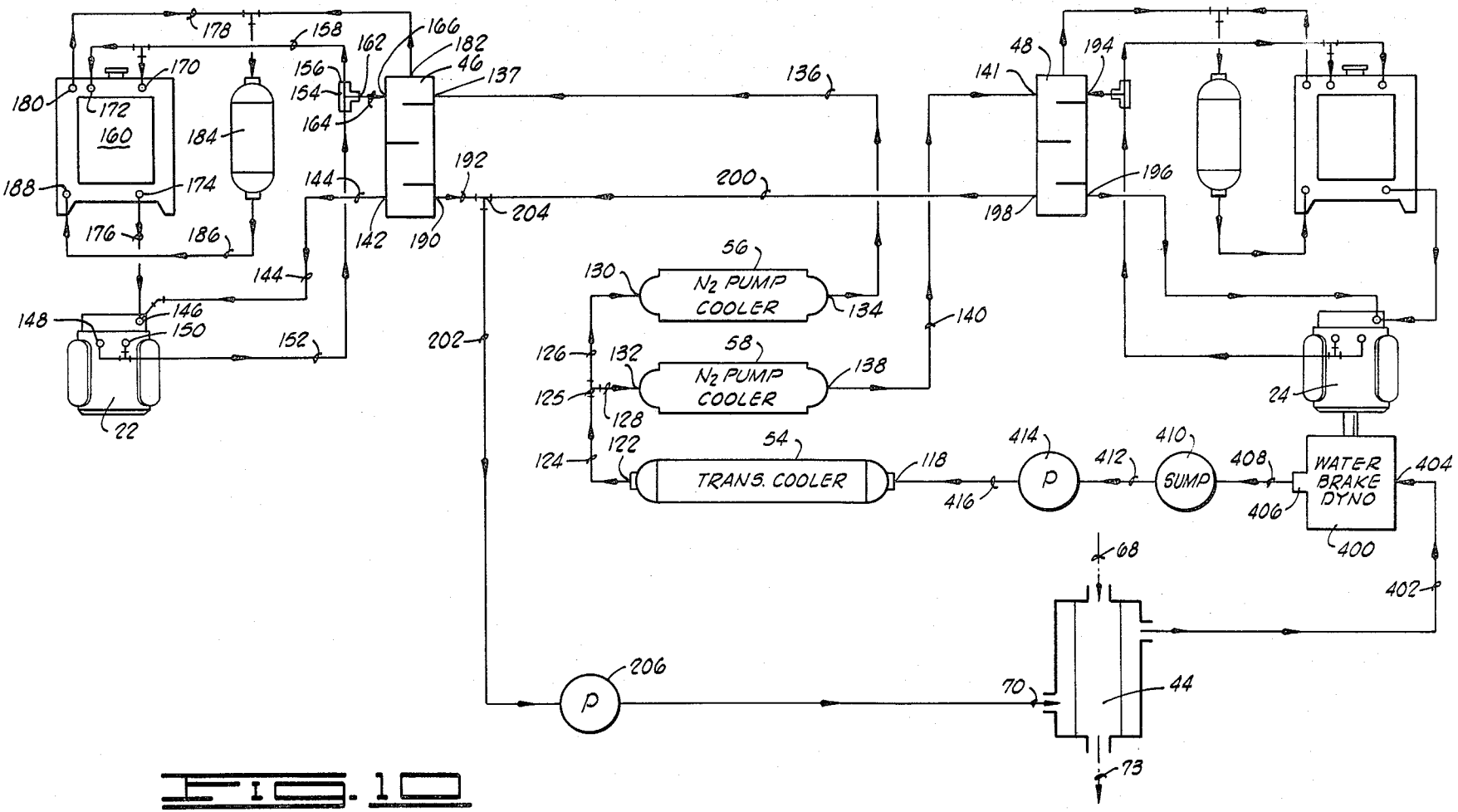
FIG. 10 is a schematic representation, similar to FIG. 4, illustrating an alternative embodiment of the present invention wherein the second engine drives a water brake dynamometer.

In FIG. 10 an alternative embodiment of the present invention is illustrated, in which the pumps 226, 228 and 230 and the attached system shown in the lower portion of FIG. 5 are replaced by a water brake dynamometer 400 which is driven by second engine 24. Water brake dynamometer 400 is an alternative means for exerting a varying load on engine 24 so that the amount of heat transferred from engine 24 to the coolant fluid, and then from the coolant fluid to the liquid nitrogen in the coolant fluid heat exchanger 44, increases as the load exerted on engine 24 is increased.

In the embodiment of FIG. 10, coolant fluid exiting the shell side of heat exchanger 44 is carried by a conduit 402 to an inlet 404 of water brake dynamometer 400. Water brake dynamometer 400 acts as an inefficient centrifugal pump to convert mechanical energy from engine 24 into heat energy in the coolant fluid. The load exerted on engine 24 is varied by varying the back pressure against which dynamometer 400 is pumping. This is done by means of a back pressure valve 406.

Coolant fluid exiting back pressure valve 406 is at approximately 0 psig and is carried by conduit 408 to a sump 410.

The coolant fluid is taken from sump 410 by a suction line 412 leading to a coolant fluid booster pump 414 which boosts the pressure of the coolant fluid up to approximately 8 psig as is required for proper operation of the remainder of the system.

A conduit 416 carries the coolant fluid from pump 414 to tube side inlet 118 of transmission cooler 54. The remainder of the system shown in FIG. 10 is similar to that of FIG. 4.

Thus it is seen that the flameless nitrogen vaporizing skid unit of the present invention is readily adapted to attain the ends and advantages mentioned as well as those inherent therein. While presently preferred embodiments of the invention have been illustrated for the purposes of the present disclosure, numerous changes in the construction and arrangement of parts may be made by those skilled in the art which changes are encompassed within the spirit and scope of this invention as defined by the appended claims.

What is claimed is:

1. A method of heating a first fluid, said method comprising the steps of:

pumping said first fluid with a main pump means;

driving said main pump means with a first internal combustion engine;

operating a second internal combustion engine;

circulating a coolant fluid through a coolant system means;

transferring heat energy from said first and second internal combustion engines to said coolant fluid;

transferring heat energy from said coolant fluid to said first fluid in a coolant fluid-to-first fluid heat exchanger; and exerting a varying load on said second internal combustion engine and thereby transferring an increased amount of heat energy from said second internal combustion engine to said coolant fluid and from said coolant fluid to said first fluid as said load exerted on said second internal combustion engine is increased.

2. An apparatus for heating a first fluid, comprising:

a first internal combustion engine;

a second internal combustion engine;

a coolant system means for circulating a coolant fluid and transferring heat energy from said first and second internal combustion engines to said coolant fluid;

a coolant fluid-to-first fluid heat exchanger means for transferring heat energy from said coolant fluid to said first fluid;

a main pump means, drivingly connected to said first internal combustion engine, for pumping said first fluid; and a variable load means, connected to said second internal combustion engine, for exerting a varying load on said second internal combustion engine so that an amount of heat energy transferred from said second internal combustion engine to said coolant fluid and from said coolant fluid to said first fluid increases as said load exerted on said second internal combustion engine by said variable load means is increased.

3. An apparatus for heating a first fluid, comprising:

a power source;

a first heat exchanger means for heating said first fluid; and a coolant system means for removing heat energy from said power source and supplying heat energy to said first heat exchanger means to heat said first fluid, said coolant system means including:

first coolant fluid conducting means for conducting a coolant fluid from said power source to said first heat exchanger means;

second coolant fluid conducting means for conducting said coolant fluid from said first heat exchanger means to said power source;

transfer means, connected to said first and second coolant fluid conducting means between said power source and said heat exchanger means, for transferring heat energy from coolant fluid in said first coolant fluid conducting means to coolant fluid in said second coolant fluid conducting means, said transfer means being so constructed that coolant fluid in a portion of said first coolant fluid conducting means downstream of said transfer means is cooler than coolant fluid in a portion of said first coolant fluid conducting means upstream of said transfer means, and coolant fluid in a portion of said second coolant fluid conducting means downsteam of said transfer means is warmer than coolant fluid in said second coolant fluid conducting means upstream of said transfer means; and wherein said first and second coolant fluid conducting means are each connected to inlets at a first end portion of said transfer means, and are each connected to outlets at second end portion of said transfer means.

4. An apparatus for heating a first fluid, comprising:

an internal combustion engine;

a coolant system means for circulating a coolant fluid and transferring heat energy from said internal combustion engine to said coolant fluid;

an exhaust-to-first fluid heat exchanger means for transferring heat energy from exhaust gases produced by said internal combustion engine directly to said first fluid; and a coolant fluid-to-first fluid heat exchanger means for transferring heat energy from said coolant fluid directly to said first fluid;

wherein said exhaust-to-first fluid heat exchanger means and coolant fluid-to-first fluid heat exchanger means are so arranged relative to a direction of flow of said first fluid that said exhaust-to-first fluid heat exchanger means is located upstream from said coolant fluid-to-first fluid heat exchanger means.

5. The method of claim 1, further comprising the steps of:

operating said second internal combustion engine independently of said first internal combustion engine;

monitoring a temperature of said first fluid; and selectively activating and deactivating said second internal combustion engine in response to said temperature of said first fluid so that said second internal combustion engine is selectively used as an auxiliary heat source in addition to said first internal combustion engine when an amount of heat energy transferred from said first internal combustion engine to said coolant fluid is insufficient for heating said first fluid to a desired temperature.

6. The method of claim 1, wherein said step of exerting a varying load includes steps of:

driving a hydraulic pump with said second internal combustion engine; and varying a back pressure on said hydraulic pump.

7. The method of claim 1, wherein said step of exerting a varying load includes steps of:

driving a water brake dynamometer with said second internal combustion engine; and varying a back pressure on said water brake dynamometer.

8. The apparatus of claim 2, wherein:

said second internal combustion engine is operable independent of said first internal combustion engine, so that said second internal combustion engine may be selectively used as an auxiliary heat source in addition to said first internal combustion engine when an amount of heat energy transferred from said first internal combustion engine to said coolant fluid is insufficient to provide sufficient heat energy for heating said first fluid to a desired temperature in said coolant fluid-to-first fluid heat exchanger means.

9. The apparatus of claim 2, wherein:

said variable load means includes a hydraulic pump means, driven by said second internal combustion engine, for pumping a hydraulic fluid against a controlled variable discharge pressure, so that the load on said second internal combustion engine is increased by increasing said discharge pressure.

10. The apparatus of claim 9, further comprising:

hydraulic fluid-to-coolant fluid heat exchanger means for transferring heat energy from said hydraulic fluid to said coolant fluid.

11. The apparatus of claim 10, further comprising:

a main pump lubricating fluid circulation system for providing lubricating fluid to said main pump; and lubricating fluid-to-coolant fluid heat exchanger means, connected between said main pump lubricating fluid circulation system and said coolant system means, for transferring heat energy from said lubricating fluid to said coolant fluid.

12. The apparatus of claim 11, wherein:

said hydraulic fluid-to-coolant fluid heat exchanger means and said lubricating fluid-to-coolant fluid heat exchanger means are located, relative to a direction of flow of said coolant fluid in said coolant system means, downstream from said coolant fluid-to-first fluid heat exchanger means and upstream of said first and second internal combustion engines.

13. The apparatus of claim 12, wherein:

said coolant system means includes a first coolant fluid conducting means for conducting said coolant fluid from said first and second internal combustion engines to said coolant fluid-to-first fluid heat exchanger means and a second coolant fluid conducting means for conducting said coolant fluid from said coolant fluid-to-first fluid heat exchanger means to said first and second internal combustion engines, said hydraulic fluid-to-coolant fluid heat exchanger means and said lubricating fluid-to-coolant fluid heat exchanger means being disposed in said second coolant fluid conducting means.

14. The apparatus of claim 13, wherein:

said first and second internal combustion engines are connected in parallel between said first and second coolant fluid conducting means, so that said coolant fluid flowing from said second coolant fluid conducting means to said first coolant fluid conducting means is split into first and second coolant fluid streams flowing past said first and second internal combustion engines, respectively.

15. The apparatus of claim 14, further comprising:

comingling chamber means, connected to a portion of said first and second coolant fluid conducting means within which said first stream of coolant fluid flows, for comingling coolant fluid from said first coolant fluid conducting means with coolant fluid from said second coolant fluid conducting means and thereby transferring heat energy from said coolant fluid in said first coolant fluid conducting means to coolant fluid in said second coolant fluid conducting means.

16. The apparatus of claim 2, wherein:

said variable load means includes a water brake dynamometer means, driven by said second internal combustion engine, for converting mechanical energy of said second internal combustion engine into heat energy in said coolant fluid as said coolant fluid is moved through said water brake dynamometer.

17. The apparatus of claim 16, wherein:

said water brake dynamometer means includes a variable back pressure valve means for varying a back pressure against which said water brake dynamometer pumps said coolant fluid so that a load exerted on said second internal combustion engine is varied as said back pressure is varied.

18. The apparatus of claim 17, further comprising:

sump means for receiving coolant fluid from said back pressure valve means; and booster pump means for taking said coolant fluid from said sump means and pressurizing said coolant fluid.

19. The apparatus of claim 16, further comprising:

a main pump lubricating fluid circulation system for providing lubricating fluid to said main pump; and lubricating fluid-to-coolant fluid heat exchanger means, connected between said main pump lubricating fluid circulation system and said coolant system means, for transferring heat energy from said lubricating fluid to said coolant fluid, 20. The apparatus of claim 19, wherein:

said water brake dynamometer and said lubricating fluid-to-coolant fluid heat exchanger means are located, relative to a direction of flow of said coolant fluid in said coolant system means, downstream from said coolant fluid-to-first fluid heat exchanger means and upstream of said first and second internal combustion engines.

21. The apparatus of claim 20, wherein:

said coolant system means includes a first coolant fluid conducting means for conducting said coolant fluid from said first and second internal combustion engines to said coolant fluid-to-first fluid heat exchanger means and a second coolant fluid conducting means for conducting said coolant fluid from said coolant fluid-to-first fluid heat exchanger means to said first and second internal combustion engines, said water brake dynamometer and said lubricating fluid-to-coolant fluid heat exchanger means being disposed in said second coolant fluid conducting means.

22. The apparatus of claim 21, wherein:

said first and second internal combustion engines are connected in parallel between said first and second coolant fluid conducting means, so that said coolant fluid flowing from said second coolant fluid conducting means to said first coolant fluid conducting means is split into first and second coolant fluid streams flowing past said first and second internal combustion engines, respectively.

23. The apparatus of claim 22, further comprising:

comingling chamber means, connected to a portion of said first and second coolant fluid conducting means within which said first stream of coolant fluid flows, for comingling coolant fluid from said first coolant fluid conducting means with coolant fluid from said second coolant fluid conducting means and thereby transferring heat energy from said coolant fluid in said first coolant fluid conducting means to coolant fluid in said second coolant fluid conducting means.

24. The apparatus of claim 2, wherein:

said coolant system means includes a first coolant fluid conducting means for conducting said coolant fluid from said first and second internal combustion engines to said coolant fluid-to-first fluid heat exchanger means and a second coolant fluid conducting means for conducting said coolant fluid from said coolant fluid-to-first fluid heat exchanger means to said first and second internal combustion engine.

25. The apparatus of claim 24, wherein:

said first and second internal combustion engines are connected in parallel between said first and second coolant fluid conducting means, so that said coolant fluid flowing from said second coolant fluid conducting means to said first coolant fluid conducting means is split into first and second coolant fluid streams flowing past said first and second internal combustion engines, respectively.

26. The apparatus of claim 25, further comprising:

comingling chamber means, connected to a portion of said first and second coolant fluid conducting means within which said first stream of coolant fluid flows, for comingling coolant fluid from said first coolant fluid conducting means with coolant fluid from said second coolant fluid conducting means and thereby transferring heat energy from said coolant fluid in said first coolant fluid conducting means to coolant fluid in said second coolant fluid conducting means.

27. The apparatus of claim 2, further comprising:

an exhaust-to-first fluid heat exchanger means for transferring heat energy from exhaust gases produced by said first and second internal combustion engines directly to said first fluid.

28. The apparatus of claim 27, wherein said exhaust-to-first fluid heat exchanger means and coolant fluid-to-first fluid heat exchanger means are so arranged relative to a direction of flow of said first fluid that said exhaust-to-first fluid heat exchanger means is located upstream from said coolant fluid-to-first fluid heat exchanger means.

29. The apparatus of claim 28, further comprising:

first bypass means for bypassing said first fluid past said exhaust-to-first fluid heat exchanger means.

30. The apparatus of claim 27, wherein:

said first bypass means is further characterized as being a controllable bypass means for bypassing a controlled portion of said first fluid.

31. The apparatus of claim 29, further comprising:

second bypass means for bypassing said first fluid past said exhaust-to-first fluid heat exchanger means and said coolant fluid-to-first fluid heat exchanger means.

32. The apparatus of claim 31, wherein:

said second bypass means is operable independent of said first bypass means.

33. The apparatus of claim 28, further comprising:

bypass means for bypassing said first fluid past said exhaust-to-first fluid heat exchanger means and said coolant fluid-to-first fluid heat exchanger means.

34. The apparatus of claim 33, wherein:

said bypass means is further characterized as being a controllable bypass means for bypassing a controlled portion of said first fluid.

35. The apparatus of claim 28, further characterized as being an apparatus for heating a liquid first fluid sufficiently to transform said first fluid to a superheated gaseous state, wherein:

said exhaust-to-first fluid heat exchanger means is further characterized as being a means for transferring approximately enough heat energy from said exhaust gases to said liquid first fluid to transform said first fluid to a gaseous state; and said coolant fluid-to-first fluid heat exchanger means is further characterized as a means for superheating said gaseous first fluid.

36. The apparatus of claim 2, further comprising:

a rectangular frame having first and second opposed sides and third and fourth opposed sides, said first and second internal combustion engines being mounted upon said frame with axes of rotation of crankshafts of said first and second internal combustion engines being oriented substantially parallel to said third and fourth sides of said frame.

37. The apparatus of claim 36, further comprising:

said main pump being located on said frame between said first internal combustion engine and said second side of said frame; and transmission means for connecting said first internal combustion engine to said main pump, so that said main pump is driven by said first internal combustion engine.

38. The apparatus of claim 36, wherein:

said rectangular frame is further characterized as being a transportable skid frame.

39. The apparatus of claim 3, wherein:

said transfer means comprises a comingling means for comingling all of the coolant fluid flowing from said power source to said first heat exchanger means with all of the coolant fluid flowing from said first heat exchanger means to said power source.

40. The apparatus of claim 3, further comprising:

a second heat exchanger means for transferring heat energy to said coolant fluid.

41. The apparatus of claim 40, wherein:

said second heat exchanger means is further characterized as being a means for transferring heat energy to said coolant fluid in said second coolant fluid conducting means.

42. The apparatus of claim 41, wherein:

said second heat exchanger means is further characterized as being a means for transferring heat energy to said coolant fluid in a portion of said second coolant fluid conducting means between said first heat exchanger means and said transfer means.

43. The apparatus of claim 40, wherein:

said second heat exchanger means is further characterized as being a means for transferring heat energy from a lubricating fluid for mechanical equipment driven by said power source to said coolant fluid.

44. The apparatus of claim 3, wherein:

said power source is an internal combustion engine.

45. The apparatus of claim 44, further comprising:

exhaust-to-first fluid heat exchanger means for transferring heat energy from exhaust gases exhausted by said engine directly to said first fluid.

46. The apparatus of claim 45, wherein:

said exhaust-to-first fluid heat exchanger means and said first heat exchanger means are so arranged that heat energy is transferred to said first fluid by said exhaust-to-first fluid heat exchanger means before heat energy is transferred to said first fluid by said first heat exchanger means.

47. The apparatus of claim 46, further comprising:

first bypass means for bypassing said first fluid past said exhaust-to-first fluid heat exchanger means.

48. The apparatus of claim 47, wherein:

said bypass means is further characterized as being a controllable bypass means for bypassing a controlled portion of said first fluid.

49. The apparatus of claim 47, further comprising:

second bypass means for bypassing said first fluid past said exhaust-to-first fluid heat exchanger means and said first heat exchanger means.

50. The apparatus of claim 49, whetein:

said second bypass means is operable independent of said first bypass means.

51. The apparatus of claim 50, wherein:

said bypass means is further characterized as being a controllable bypass means for bypassing a controlled portion of said first fluid.

52. The apparatus of claim 45, further comprising:

bypass means for bypassing said first fluid past said exhaust-to-first fluid heat exchanger means and said first heat exchanger means.

53. The apparatus of claim 3, wherein:

said first end portion of said transfer means is an upper end portion;

said second end portion of said transfer means is a lower end portion; and said coolant fluid flowing through each of said first and second coolant fluid conducting means flows downward through said transfer means.

54. The apparatus of claim 3, wherein:

said transfer means includes an elongated cylindrical housing.

55. The apparatus of claim 54, wherein:

said transfer means further includes a plurality of baffles interposed between said inlets and said outlets to insure thorough comingling of said coolant fluid from said first and second coolant fluid conducting means as said coolant fluid flows through said transfer means.

56. The apparatus of claim 4; further comprising:

first bypass means for bypassing said first fluid past said exhaust-to-first fluid heat exchanger means.

57. The apparatus of claim 56, wherein:

said first bypass means is further characterized as being a controllable bypass means for bypassing a controlled portion of said first fluid.

58. The apparatus of claim 56, further comprising:

second bypass means for bypassing said first fluid past said exhaust-to-first fluid heat exchanger means and said coolant fluid-to-first fluid heat exchanger means.

59. The apparatus of claim 58, wherein:

said second bypass means is operable independent of said first bypass means.

60. The apparatus of claim 4, further comprising:

bypass means for bypassing said first fluid past said exhaust-to-first fluid heat exchanger means and said coolant fluid-to-first fluid heat exchanger means.

61. The apparatus of claim 60, wherein:

said bypass means is further characterized as being a controllable bypass means for bypassing a controlled portion of said first fluid.

62. The apparatus of claim 4, further characterized as being an apparatus for heating a liquid first fluid sufficiently to transform said first fluid to a superheated gaseous state, wherein:

said exhaust-to-first fluid heat exchanger means is further characterized as being a means for transferring approximately enough heat energy from said exhaust gases to said liquid first fluid to transform said first fluid to a gaseous state; and said coolant fluid-to-first fluid heat exchanger means is further characterized as a means for superheating said gaseous first fluid.

* * * * *

UNITED STATES PATENT AND TRADEMARK OFFICE

CERTIFICATE OF CORRECTION

PATENT NO. : 4,438,729

DATED : March 27, 1984

INVENTOR(S) : Stanley B. Loesch, James C. St.John, and Danny K. Mints

It is certified that error appears in the above-identified patent and that said Letters Patent is hereby corrected as shown below:

In column 1, line 52, delete the word [or] and insert therefor --for--.
In column 2, line 17, delete the word [hyraulic] and insert therefor --hydraulic--.
In column 3, line 5, delete the word [depenent] and insert therefor --dependent--.
In column 6, line 62, delete the word [by] and insert therefor --be--.
In column 8, line 37, delete the number [46] and insert therefor --146--.
In column 13, line 16, delete the word [mcchanical] and insert therefor --mechanical--.

Signed and Sealed this

*Fourth* Day of *September 1984*

[SEAL]

*Attest:*

*Attesting Officer*

GERALD J. MOSSINGHOFF

*Commissioner of Patents and Trademarks*